US011752401B2

(12) United States Patent
Sclafani

(10) Patent No.: US 11,752,401 B2
(45) Date of Patent: Sep. 12, 2023

(54) METHOD FOR OPTIMIZING LAUNCH CHARACTERISTICS OF A GOLF CLUB

(71) Applicant: Adam C. Sclafani, Lake Wylie, SC (US)

(72) Inventor: Adam C. Sclafani, Lake Wylie, SC (US)

(73) Assignee: GAME CHANGER INDUSTRIES LLC, Lake Wylie, SC (US)

( * ) Notice: Subject to any disclaimer, the term of this patent is extended or adjusted under 35 U.S.C. 154(b) by 101 days.

(21) Appl. No.: 17/119,088

(22) Filed: Dec. 11, 2020

(65) Prior Publication Data

US 2021/0093932 A1 Apr. 1, 2021

Related U.S. Application Data

(63) Continuation-in-part of application No. 15/788,331, filed on Oct. 19, 2017, now abandoned, which is a continuation-in-part of application No. 15/491,645, filed on Apr. 19, 2017, now abandoned.

(60) Provisional application No. 62/325,124, filed on Apr. 20, 2016.

(51) Int. Cl.
*A63B 53/04* (2015.01)

(52) U.S. Cl.
CPC ..... *A63B 53/042* (2020.08); *A63B 53/0445* (2020.08); *A63B 53/047* (2013.01); *A63B 2053/0479* (2013.01); *A63B 2209/00* (2013.01)

(58) Field of Classification Search
CPC ..... A63B 53/042; A63B 53/0445; C04B 40/0263–0268
See application file for complete search history.

(56) References Cited

U.S. PATENT DOCUMENTS 1,292,953 A * 1/1919 Jeppson et al. ..... F16D 69/022 404/19
1,336,671 A 4/1920 Backus
1,414,124 A 4/1922 Griffin
(Continued)

FOREIGN PATENT DOCUMENTS

GB 2469036 A 10/2010
GB 2486664 A 6/2012
(Continued)

OTHER PUBLICATIONS

English machine translation of Nishiyama, JP 201156099 (Year: 2011).*

(Continued)

*Primary Examiner* — Laura Davison
(74) *Attorney, Agent, or Firm* — Lippes Mathias LLP

(57) ABSTRACT

A method of enhancing surface strike performance, includes providing a club head having a face surface and a receiving portion recessed into the club face. The receiving portion is configured to receive a strike surface material. The surface strike material is an amorphous ceramic material which is inserted as an inlay into the receiving portion as a liquid slurry. The slurry is distributed evenly within said receiving portion forming a uniform layer of ceramic material filling said receiving portion. Microgrooves are added to the ceramic material in a vertical direction to further increase the strike performance of the club head.

11 Claims, 9 Drawing Sheets

(56) References Cited

U.S. PATENT DOCUMENTS

| | | | | |
|---|---|---|---|---|
| 3,172,667 | A * | 3/1965 | Baker | A63B 53/04 473/330 |
| 3,819,180 | A | 6/1974 | Murphy | |
| 3,937,474 | A | 2/1976 | Jepson et al. | |
| 3,975,023 | A * | 8/1976 | Inamori | A63B 60/00 473/329 |
| 5,423,535 | A * | 6/1995 | Shaw | A63B 60/00 473/291 |
| 5,575,472 | A * | 11/1996 | Magerman | A63B 53/0487 29/530 |
| 5,620,382 | A * | 4/1997 | Cho | A63B 53/047 473/331 |
| 5,820,491 | A | 10/1998 | Hatch et al. | |
| 6,224,497 | B1 * | 5/2001 | Antonious | A63B 53/047 473/331 |
| 6,638,182 | B2 * | 10/2003 | Kosmatka | A63B 53/04 473/331 |
| 6,939,248 | B2 | 9/2005 | Naruo et al. | |
| 6,974,392 | B2 * | 12/2005 | Chang | A63B 53/04 473/324 |
| 7,273,420 | B2 * | 9/2007 | Wright | A63B 60/02 473/340 |
| 7,491,136 | B2 * | 2/2009 | Deng | A63B 60/02 473/349 |
| 7,648,424 | B2 | 1/2010 | Hinojosa | |
| 7,762,908 | B2 * | 7/2010 | Perkins | A63B 53/0487 473/340 |
| 8,961,333 | B2 * | 2/2015 | Ballenger | A63B 53/04 473/340 |
| 8,979,669 | B2 | 3/2015 | Greaney et al. | |
| 8,979,670 | B2 * | 3/2015 | Aguayo | B23K 26/60 473/331 |
| 9,011,268 | B2 * | 4/2015 | Ban | A63B 53/04 473/331 |
| 9,283,448 | B2 | 3/2016 | Sander | |
| 9,452,326 | B2 | 9/2016 | Serrano et al. | |
| 2004/0009829 | A1 | 1/2004 | Kapilow | |
| 2004/0116198 | A1 * | 6/2004 | Schudel | A63B 53/04 473/330 |
| 2004/0127300 | A1 | 7/2004 | Roesgen et al. | |
| 2007/0004535 | A1 * | 1/2007 | Hsu | A63B 53/04 473/342 |
| 2007/0117644 | A1 * | 5/2007 | Kasula | A63B 53/0487 473/282 |
| 2008/0096682 | A1 | 4/2008 | Fox | |
| 2011/0172026 | A1 | 7/2011 | Cackett et al. | |
| 2015/0057101 | A1 | 2/2015 | Sander | |
| 2016/0346649 | A1 | 12/2016 | Jertson et al. | |
| 2017/0197121 | A1 | 7/2017 | Franklin et al. | |
| 2017/0304687 | A1 | 10/2017 | Sclafani | |
| 2018/0008871 | A1 | 1/2018 | Lafortune et al. | |
| 2018/0036606 | A1 | 2/2018 | Sclafani | |

FOREIGN PATENT DOCUMENTS

| | | | |
|---|---|---|---|
| JP | 10216275 | A | 8/1998 |
| JP | 201156099 | A * | 3/2011 |

OTHER PUBLICATIONS

Golfsmith, "Metalwood Refinishing", 2005, http://www.golfwrx.com/forums/index.php?app+core&module=attach&section=attach&attach_id=86634.

MIL-D-3134J, Military Specification for Deck Covering Materials, www.everyspec.com, published Oct. 5, 1988.

Matweb, "Overview of materials for Acetal Homopolymer, Unreinforced", www.matweb.com, Jun. 19, 2018.

POR-15 Restoration Products, POR-15 Rust Preventive Paint, www.por15.com, Brochure, 5 pages, 2017.

POR-15 Technical Information, www.por15.com, 2 sheets, 2017.

Swab, Jeffrey J. et al., "Properties and Performance of Polycrystalline Cubic Boron Nitride", International Journal of Applied Ceramic Technology, Jan. 12, 2015, Abstract.

TrackMan Blog, "What is Spin Rate?", https://blog.trackmangolf.com/spin-rate/, captured Aug. 10, 2014.

Wood, Dave, "Classical Wood Restoration Process", http://www.davewoodarts.com/WoodRestoreProcess6.html, captured May 20, 2012.

* cited by examiner

METHOD FOR OPTIMIZING LAUNCH CHARACTERISTICS OF A GOLF CLUB

CROSS-REFERENCE TO RELATED APPLICATIONS

This application is a continuation-in-part of U.S. patent application Ser. No. 15/788,331, filed on Oct. 19, 2017, which is a continuation-in-part of U.S. patent application Ser. No. 15/491,645, filed Apr. 19, 2017, which claims priority to U.S. Provisional Patent Application Ser. No. 62/325,124, filed Apr. 20, 2016. The disclosure of each of the aforementioned patent applications is fully incorporated herein by reference.

BACKGROUND OF THE DISCLOSURE

The present disclosure relates to golf clubs and related sports applications. More particularly, it relates to enhanced surface strike performance of a golf club head, which may be achieved by an insert attached to the golf club head. Although a preferred embodiment of the present disclosure is directed to a golf club head, it is contemplated that other types of sports equipment (e.g., baseball bats, hockey sticks, polo mallets, croquet mallets bocce balls, bowling balls, billiard balls, etc., and the like) may similarly benefit from the enhanced surface strike performance disclosed herein.

The design of typical golf clubs includes specific features that affect the flight characteristics of the golf ball after impact. For example, the loft angle of the club, face grooves and surface characteristics of the club impart a combination of angular spin and forward velocity at impact. The forward velocity is further directed along a vector (launch angle) by virtue of the ball's interaction with the clubface at impact.

The introduction of spin can be a benefit for the highly skilled golfer and allow the golfer to "work the ball" by deliberately curving the flight path in a left-to-right or right-to-left direction. High spin rates may also facilitate the skilled golfer in reducing the amount of travel on the ground of short shots to the green (i.e., getting the ball to "check up").

The vast majority of golfers are insufficiently skilled in the control of spin on the ball. Therefore, the inadvertent and errant introduction of spin commonly results in either hooking or slicing the balls flight path in an unintended direction.

At impact, the club head transfers its kinetic energy to the ball. Conventional golf clubs impart some energy to spin the ball and the remaining energy to propel the ball. Depending upon the angle of impact of the club face the proportion of energy diverted to either spin or propulsion will vary.

It is preferable to configure a golf club head to achieve less spin, greater launch angle and increased carry distance. Historically, one known way modify these golf ball characteristics is to use a "slippery" clubface. For example, Vaseline®, Chopstick®, or other temporary substances applied to the striking face of the golf club is widely known. These practices, however, are not "legally conforming" to the Rules of Golf issued by the United States Golf Association ("USGA"), as these substances are "temporary modifications." The removal of grooves on the golf clubface is also widely known in the industry to modify the aforementioned characteristics of golf balls, and clubs having groove-less and highly polished clubfaces are currently marketed today.

Several patents disclose a number of attempts to achieve these results. For example, U.S. Pat. No. 6,974,392 ("Chang") describes a golf club for minimizing spin of the golf ball. The method described employs the use of low friction substances that cover the impact surface of the golf club, such as PTFE and variants of PTFE (Teflon). These substances are known for their low coefficient of friction, and are thus an obvious attribute for coating that is expected to reduce the spin of a struck golf ball.

Chang further describes how to overcome the limitations of the method that was previously discussed in U.S. Pat. No. 5,423,535 ("Shaw"). Shaw also listed PTFE as a candidate for spin reduction treatment of golf club face. While being somewhat effective, this approach of using PTFE had limited functionality and practicality. As a result, the PTFE coatings on the golf club did not reach the level of performance expectation. Chang describes the problem as ultimately relating to the softness of the PTFE and that at impact the compression of the golf ball into the layer of PTFE produces a mechanical engagement of the ball against the surface and introduces unexpected and unwanted spin of the golf ball. The solution proposed in Chang is to limit the thickness of the PTFE coating and employ a supporting layer under the PTFE. However, this limits the degree of mechanical engagement of the PTFE layer with the golf ball.

Existing golf club heads use coatings or inserts placed over or into areas of golf club heads to improve strike performance. A problem with some of these coatings and inserts is they are not durable enough and do not have the proper hardness to withstand striking the ground or sand, for example. Moreover, some inserts need a separate adhesive layer to affix them to the club head, which compromises durability. Thus, there is a need for a new and improved method for providing a strike surface of a golf club which will overcome the above mentioned deficiencies while providing better overall results. Specifically, the present disclosure overcomes the limitations of the existing attempts through the use of non-obvious methods.

SUMMARY OF THE DISCLOSURE

The present disclosure relates to golf clubs and related sports applications. More particularly, it relates to an enhanced strike surface of a golf club head, which may be achieved by an insert attached to the golf club head.

In the present disclosure a much more significant portion of the kinetic energy is transferred to the propulsion of the golf ball forward/upward and a much lower amount of the energy (than conventional golf clubs) is converted to rotational energy that spins the ball. This results in an improved launch angle and greater carry distance than a conventional golf club for any given clubhead speed at impact and less inadvertent loss of accuracy from off axis spin of the ball.

In particular, the present disclosure describes a method for producing golf clubs that have design features and characteristics that enhance the directional accuracy, reduce the inadvertent hooking and slicing and improve the distance performance of a golf club of given loft angle.

The present disclosure overcomes the cost and complexity of such manufacturing techniques and results in a dramatic improvement in golf club performance.

Specifically, in accordance with one embodiment of the disclosure, the ball striking surface of the clubface is provided by an insert attached to the clubface. The insert can be substantially smooth or can have surface features as described below. Moreover, the insert provides the ball striking surface having an advantageous combination of properties, such as smoothness, hardness and durability.

Furthermore, in accordance with another embodiment of the disclosure, the insert includes a ball striking surface having surface features configured as one or more ridges or ribs. Alternatively, the one or more surface features can be configured as one or more grooves. The one or more surface features can further be configured as punch marks spaced across the insert. In still a further embodiment, the one or more surface features can be configured as a combination of ridges, grooves, and/or punch marks. The insert and ball striking surface with surface features are made from a material providing an advantageous combination of properties, such as smoothness, hardness and durability, adapted to improve golf club performance. The intrinsic coefficient of friction is not a critical characteristic of the chosen material for the insert and ball striking surface that results in the enhanced performance.

In one particular embodiment of the disclosure, the insert and its ball striking surface are made from an injection moldable material which provides enhanced performance. The injection moldable material can be a polymeric material which includes Acetal.

In accordance with another aspect of the disclosure, a golf club head has a designated region on the face of the club configured to receive an inlay material which creates an improved strike surface. The region is configured as a recess or pocket. An amorphous ceramic material is applied to the recess or pocket as a liquid slurry and forms the inlay material.

In accordance with another aspect of the disclosure, a method of enhancing surface strike performance, includes the step of providing a club head having a face surface; the receiving portion is configured to receive an inlay material; the inlay material includes amorphous ceramic material which is deposited into the receiving portion as a liquid slurry forming the striking surface of the golf club's head.

In accordance with one aspect of the disclosure, the slurry is distributed evenly within the receiving portion forming a uniform layer of ceramic material filling the receiving portion and forming a striking surface for the club head.

In accordance with another aspect of the disclosure, the slurry is dried while the club head is positioned parallel to the ground.

In accordance with another aspect of the disclosure, the club head is heated while the temperature is slowly increased until the temperature is uniform just below the glassification temperature of the ceramic material.

In accordance with another aspect of the disclosure, the temperature is increased to create glassification of the ceramic material.

In accordance with another aspect of the disclosure, the ceramic material is ground with a series of abrasive members creating microspores in or on outer surface of the ceramic material.

In accordance with another aspect of the disclosure, the microgrooves extend in a vertical direction along the outer surface of the ceramic material.

In accordance with another aspect of the disclosure, the receiving portion extends across a substantial portion of a width of said club head.

In accordance with another aspect of the disclosure, the receiving portion has a depth of about 0.75 mm or 0.03 inches.

In accordance with another aspect of the disclosure, the ceramic material has a depth of about 0.75 mm or 0.03 inches.

Still other aspects of this disclosure will become apparent upon reading and understanding of the present disclosure.

BRIEF DESCRIPTION OF THE DRAWINGS

For a better understanding of the present invention, reference may be had to the following detailed description taken in conjunction with the accompanying drawings in which.

DETAILED DESCRIPTION OF THE DISCLOSURE

Figure 1:
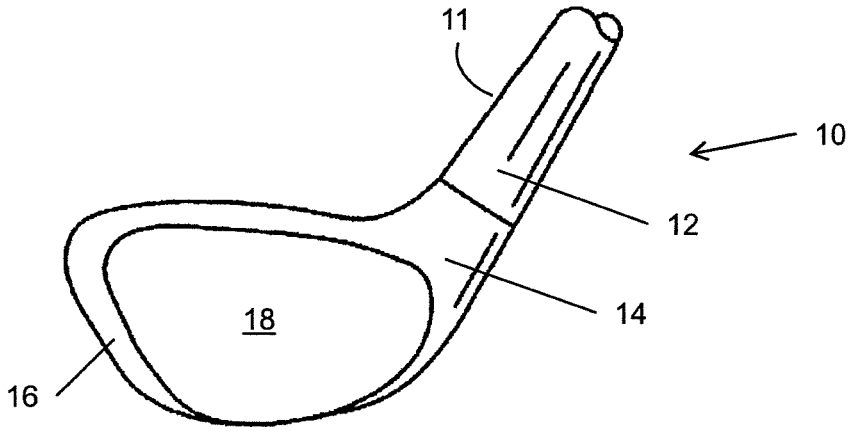
FIG. 1 is a partial perspective view of a golf club including a clubface with a ball striking surface having enhanced performance in accordance with one embodiment of the present disclosure.

A preferred embodiment of the present disclosure is a golf club of low cost manufacture that includes a ball striking surface able to perform to the above specifications. For a performance enhancing ball-striking surface to be practical and useful it must be durable, smooth, resist impact forces of normal use, and reduce the imparted spin on the golf ball. The USGA requires that the surface have a hardness that passes the "fingernail test." This hardness corresponds to a Mohs hardness of 2.5, compared with a copper penny having a Mohs hardness of 3.0. The intent of this ruling is to render common lubricants, adhesive patches and other waxy or liquid substances that may be applied to the striking surface as non-conforming.

In contrast, existing methods use surface coatings (PTFE and its variants) with a specific coefficient of friction. Coefficient of friction is a complex property that is known to be unpredictable and can be highly dependent on normal forces at the contact surfaces as well as being limited by the mechanical properties of the substances being tested (i.e., hardness, compressive strength, yield strength, etc.). While PTFE would seem to be a viable substance to coat a golf club for reduced spin, it has been determined that, from a practical standpoint, PTFE has fails to be useful. In particular, PTFE is not sufficiently durable or impact resistant to satisfy the requirements of a viable surface of a golf club.

According to one embodiment of the present disclosure, a ball striking surface of the clubface is the surface of an insert attached to the clubface of the golf club. The ball striking surface may be substantially smooth or comprise one or more surface features. The ball striking surface of the golf club satisfying the physical attributes listed below, while still meeting the physical attributes required by the USGA, will reduce a spin rate, increase a launch angle, and increase a carry distance on the golf ball compared with a similar golf club without the ball striking surface of the present disclosure.

Specifically, in accordance with the preferred embodiment of this disclosure, the resulting ball striking surface 18 (see FIGS. 1-7) may include some or all of the following properties:

a) A hardness of greater than Shore D 65;

b) A surface roughness Ra of 1.0 micron or less (i.e., a substantially smooth surface), where Ra is the roughness average of the ball striking surface's measured microscopic peaks and valleys;

c) A wear resistance minimum of zero loss at 1 kg per 1000 Cycles (ASTM-C-501);

d) A flexural strength of greater than 3000 psi (ASTM C-580);

e) An indentation resistance (Mil-D-3134F sec 4.7.4) of greater than 1500 psi for a duration of 30 minutes;

f) A tensile strength of greater than 3000 psi (ASTM C-307); and g) A compressive strength of greater than 5000 psi.

A ball striking surface having a combination of some or all of properties a)-g) above has been found to dramatically improve the performance characteristics of a golf ball struck by the ball striking surface. For example, the hardness and compressive strength properties of the ball striking surface in combination with the smoothness prevents the golf ball from developing significant mechanical engagement with ball striking surface upon impact with the golf club, thereby reducing the amount of imparted spin.

Referring now to FIG. 1, a golf club 10 is shown having a shaft 12 and a head 14 connected to the shaft in a manner well known in the art. While the golf club head 14 illustrated in FIG. 1 is shown as being configured for a driver 11 or a "wood" club, it should be understood that the present disclosure is not necessarily limited thereto, and other types of golf club heads are also contemplated (See FIGS. 3-4). Additionally, other types of sports equipment adapted to strike respective balls associated with the sport are contemplated. In this regard, the head 14 can more generally be referred to as a body member adapted to strike an associated ball. The body member or golf club head 14 includes a clubface 16, which is the surface of the golf club head that faces an associated golf ball (not shown) as a user prepares to swing the golf club. Alternatively, in more general terms, the body member 14 includes a face which is the surface of the body member that faces an associated game ball. At least a portion of the face or clubface 16 comprises a ball striking surface 18. The ball striking surface 18 is adapted to contact an associated game ball, such as a golf ball, and transfer the kinetic energy of the golf club to the golf ball. In this regard, the ball striking surface 18 may comprise substantially all of the face or clubface 16 of the body member or golf club head 14, or just a portion thereof (e.g., a centrally located "sweet spot" of the clubface).

Figure 2:
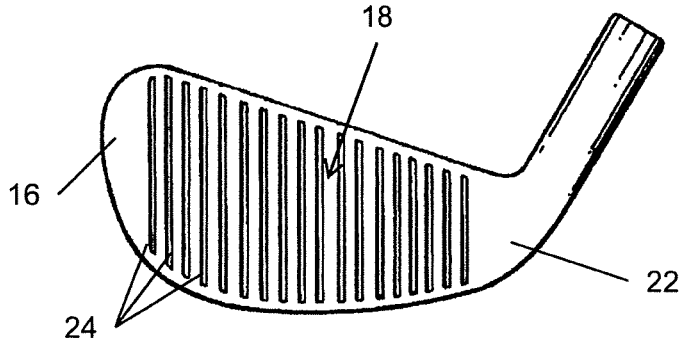
FIG. 2 is a partial perspective view of a golf club head which has surface features on the clubface in accordance with another embodiment of the present disclosure.

FIG. 2 illustrates a golf club head 22 which is configured as an "iron" club. The clubface 16 of the golf club head 22 has a ball striking surface 18 which includes surface features 24. In one embodiment, the surface features 24 can be configured as one or more ridges or ribs. Alternatively, the surface features 24 can be configured as one or more grooves. In still a further embodiment, the surface features 24 can be configured as a combination of ridges and grooves. Other surface features such as punch marks are also contemplated, and the surface features of the present disclosure are not limited to the geometry of those illustrated in FIG. 2. The ridged and/or grooved ball striking surface 18 is adapted to contact an associated golf ball and transfer the kinetic energy of the golf club to the golf ball. In this regard, the ridged and/or grooved ball striking surface 18 of golf club head 22 may comprise just a portion of the clubface 16 or substantially all of the clubface (e.g., except for perimeter portions of the clubface), provided the surface features are in accordance with the Rules of Golf issued by the USGA.

Figure 3:
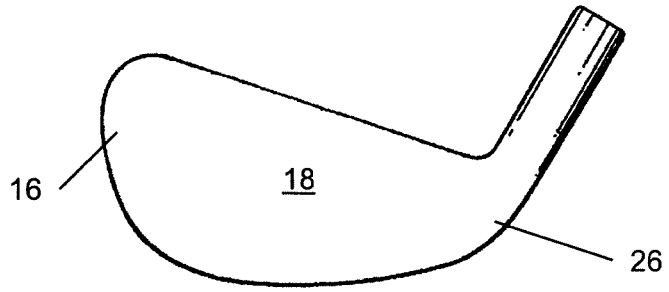
FIG. 3 is a partial perspective view of a golf club head which has a smooth clubface in accordance with another embodiment of the present disclosure.

FIG. 3 illustrates a golf club head 26 which, similar to golf club head 22 shown in FIG. 2, is also configured as an "iron" club. However, the clubface 16 of golf club head 26 has a ball striking surface 18 without any surface features. In other words, the ball striking surface 18 of head 26 is configured to be substantially smooth. The substantially smooth ball striking surface is adapted to contact an associated golf ball and transfer the kinetic energy of the golf club to the golf ball. In this regard, the substantially smooth ball striking surface 18 of golf club head 26 may comprise substantially all of the clubface 16 of the golf club head 14, or just a portion thereof (e.g., a centrally located "sweet spot" of the clubface).

Referring back to FIG. 1, the ball striking surface 18 of the golf club head 14 can be configured similarly to that of golf ball heads 22, 26 illustrated in FIGS. 2 and 3, respectfully. That is, the ball striking surface 18 of the driver golf club head 14 can be configured to have one or more ridges or grooves or be configured to be substantially smooth.

Figure 4A:
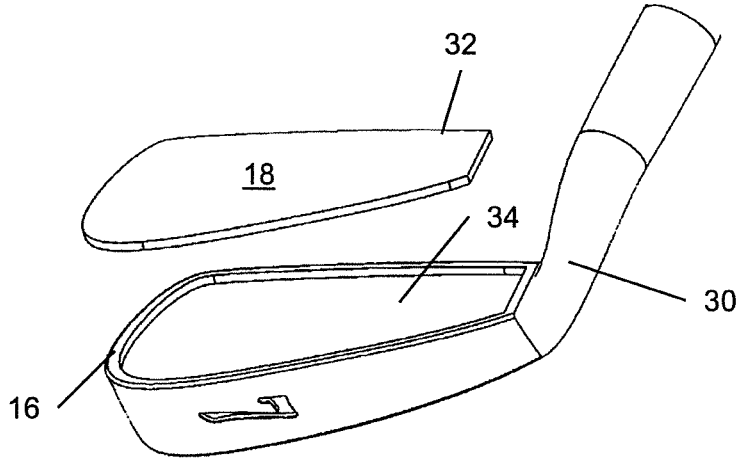
FIG. 4A illustrates a partial perspective view of a golf club head which has an insert providing a ball striking surface having enhanced performance in accordance with another embodiment of the present disclosure.

FIGS. 4A-4C and FIGS. 5-7 show a golf club head 30 which is configured as an "iron" club, such as the 7-iron illustrated in FIG. 4A. However, it should be understood that golf club head 30 could also be configured as any other iron club or as a "wood" or driver club without departing from the scope of the present disclosure. Additionally, other types of sports equipment adapted to strike respective balls associated with the sport are contemplated. In this regard, the head 30 can more generally be referred to as a body member adapted to strike an associated ball. The body member or golf club head 30 of FIGS. 4A-4C differ from those illustrated in FIGS. 1-3 in that the ball striking surface 18 comprises a separate insert 34 that is completely separate from the rest of the body member or golf club head. The separate insert 32 can be configured as an overlay insert or an inlay insert, both of which can be attached to the clubface 16. The insert 32 can be attached to the clubface 16 in a manner well known in the art, such as through the use of adhesives or through a mechanical means such as fasteners, etc. The insert 32 comprising the ball striking surface 18 is adapted to contact an associated golf ball and transfer the kinetic energy of the golf club to the golf ball.

The embodiments illustrated in FIGS. 4A-4C and FIGS. 5-7 show the insert 32 being configured as an inlay insert. In this regard, the clubface 16 includes a receiving portion 34 (FIG. 4A) adapted to receive the inlay insert 32. The inlay insert 32 is attached to the receiving portion 34 in the same manner as discussed above, i.e., through the use of adhesives or mechanical fasteners known in the art. Generally, when configured as an inlay, the insert 32 is attached to the clubface 16 to provide the ball striking surface 18 comprising just a portion of the clubface of the body member or golf club head 30 such as central portion. In this regard, the receiving portion 34 can be recessed into the clubface 16 such that the inlay insert 32, and thus the ball striking surface 18, is substantially flush with the surrounding portions of the clubface in accordance with the Rules of Golf issued by the USGA.

In other embodiments, the separate insert 32 is configured as an overlay insert (not shown). When the insert 32 is configured as an overlay, the insert is attached to the clubface 16 to provide the ball striking surface 18 comprising substantially all of the clubface of the golf club head 30. In other words, when configured as an overlay, the entire clubface 16 acts as the receiving portion for the insert 32 such that the insert completely overlays or covers the clubface. Again, when configured as an overlay insert, the insert 32 is attached to the clubface in the same manner as discussed above, i.e., through the use of adhesives or mechanical fasteners known in the art.

The ball striking surface 18 of the separate insert 32 attached to the face or clubface 16 of the body member or golf club head 30 can be configured similarly to that of golf ball heads 22, 26 illustrated in FIGS. 2 and 3, respectively. That is, the ball striking surface 18 of the insert 32 can be configured to have one or more surface features or textures, such as ridges or grooves, or be configured to be substantially smooth. In the embodiment illustrated in FIGS. 4A-4C, the ball striking surface 18 of the insert 32 is configured to be substantially smooth.

Figure 4B:
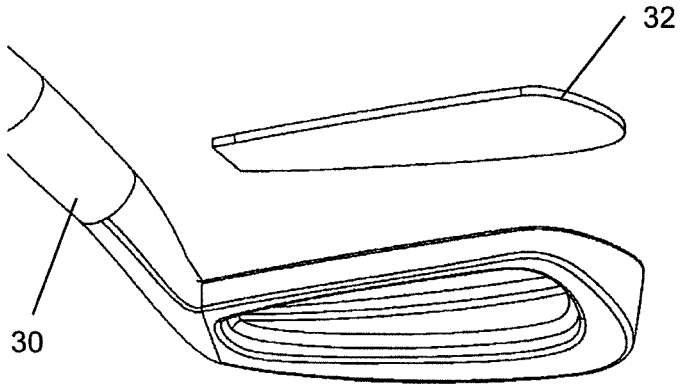
FIG. 4B illustrates a partial perspective view of a golf club head which has an insert providing a ball striking surface having enhanced performance in accordance with another embodiment of the present disclosure.
Figure 4C:
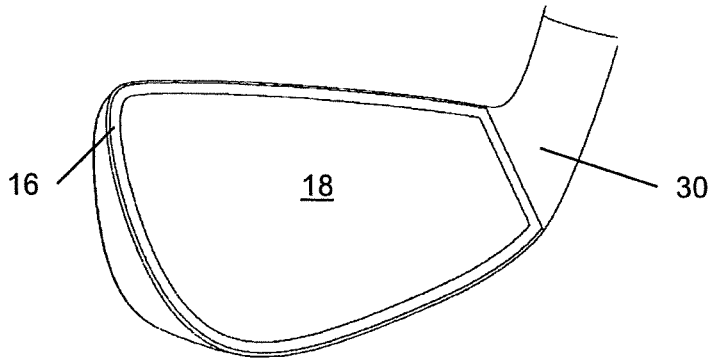
FIG. 4C illustrates a partial perspective view of a golf club head which has an insert providing a ball striking surface having enhanced performance in accordance with another embodiment of the present disclosure.
Figure 5:
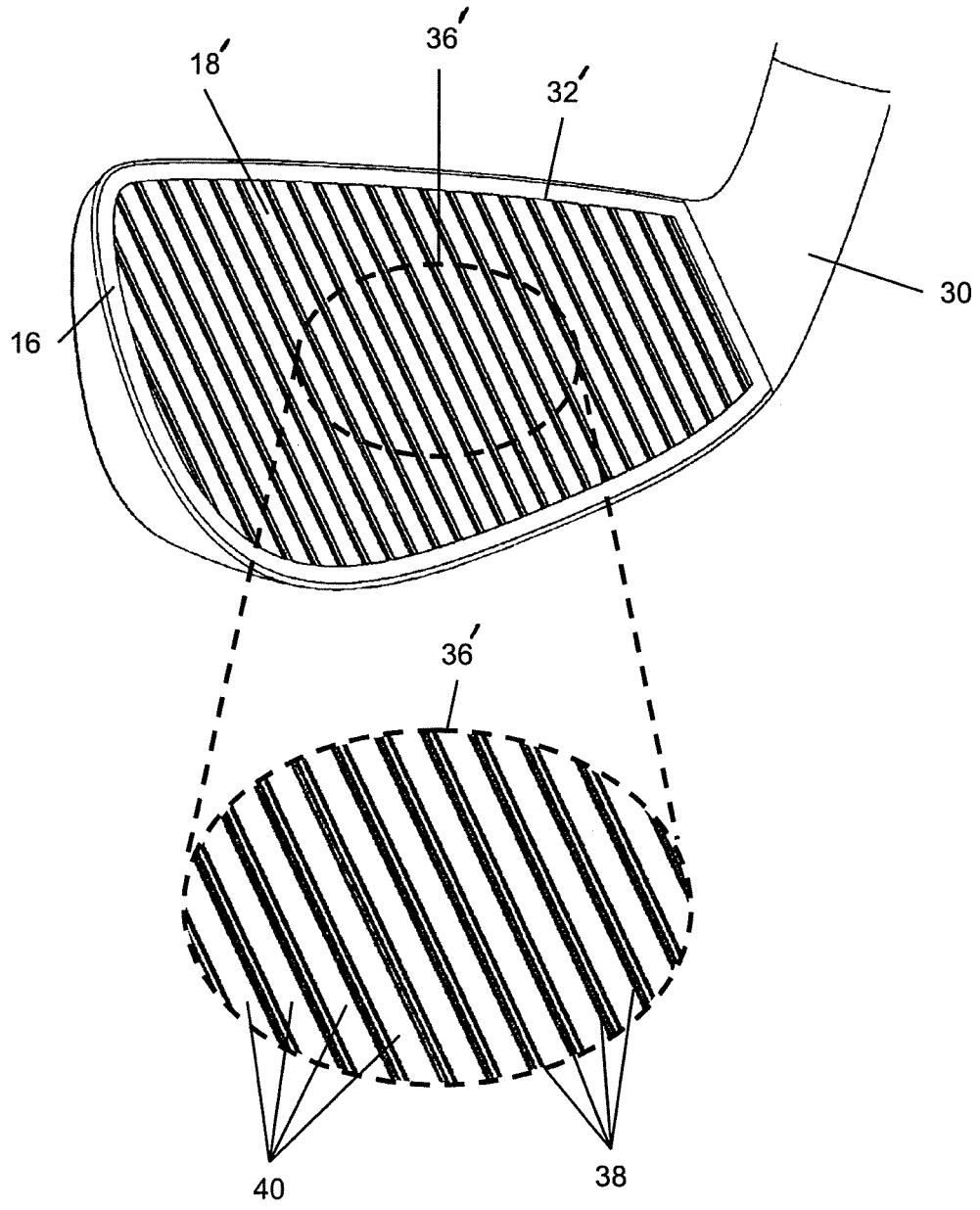
FIG. 5 is a partial perspective view of a golf club head which has an insert providing a ball striking surface which has one or more surface features, including one or more raised ridge or rib portions and/or grooved portions.
Figure 6:
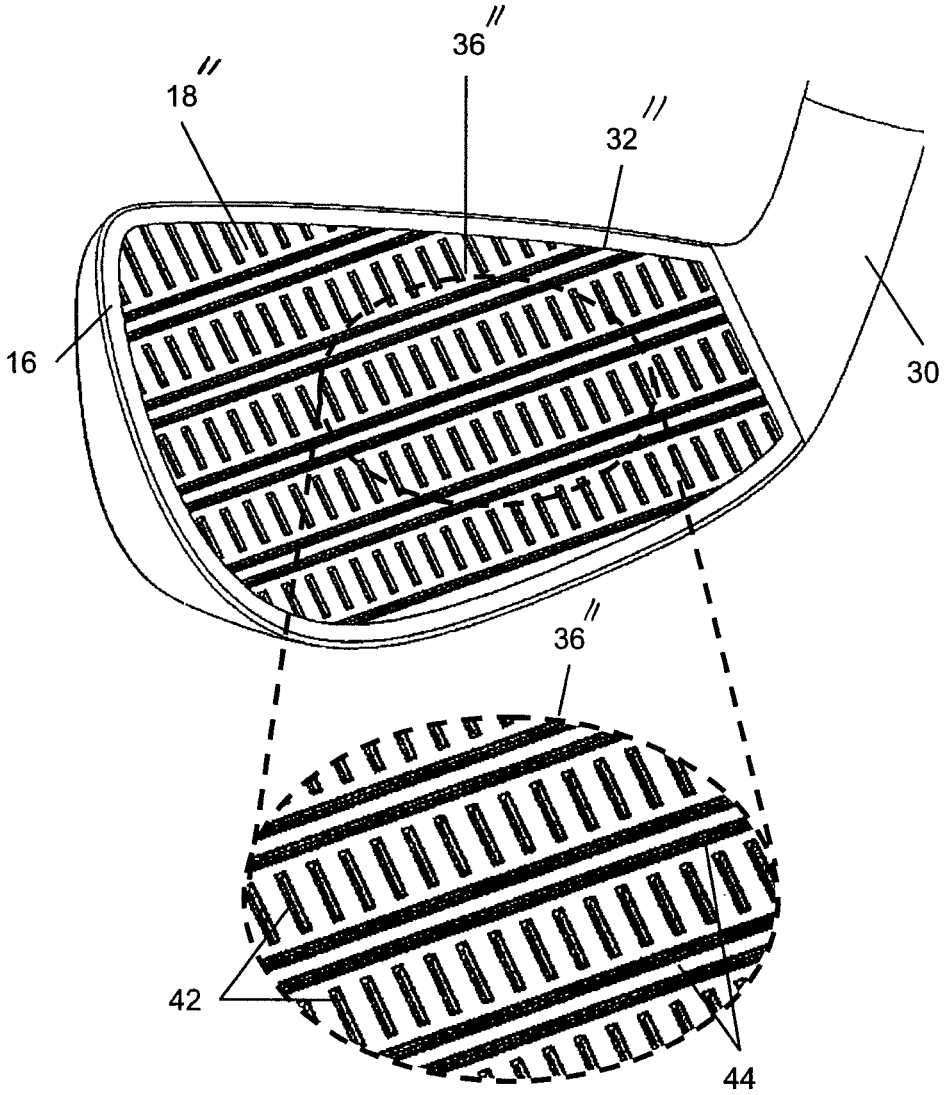
FIG. 6 is a partial perspective view of a golf club head which has an insert providing a ball striking surface which has one or more surface features, including a first repeating pattern of grooved portions and second repeating pattern of a pair of raised ridge portions.
Figure 7:
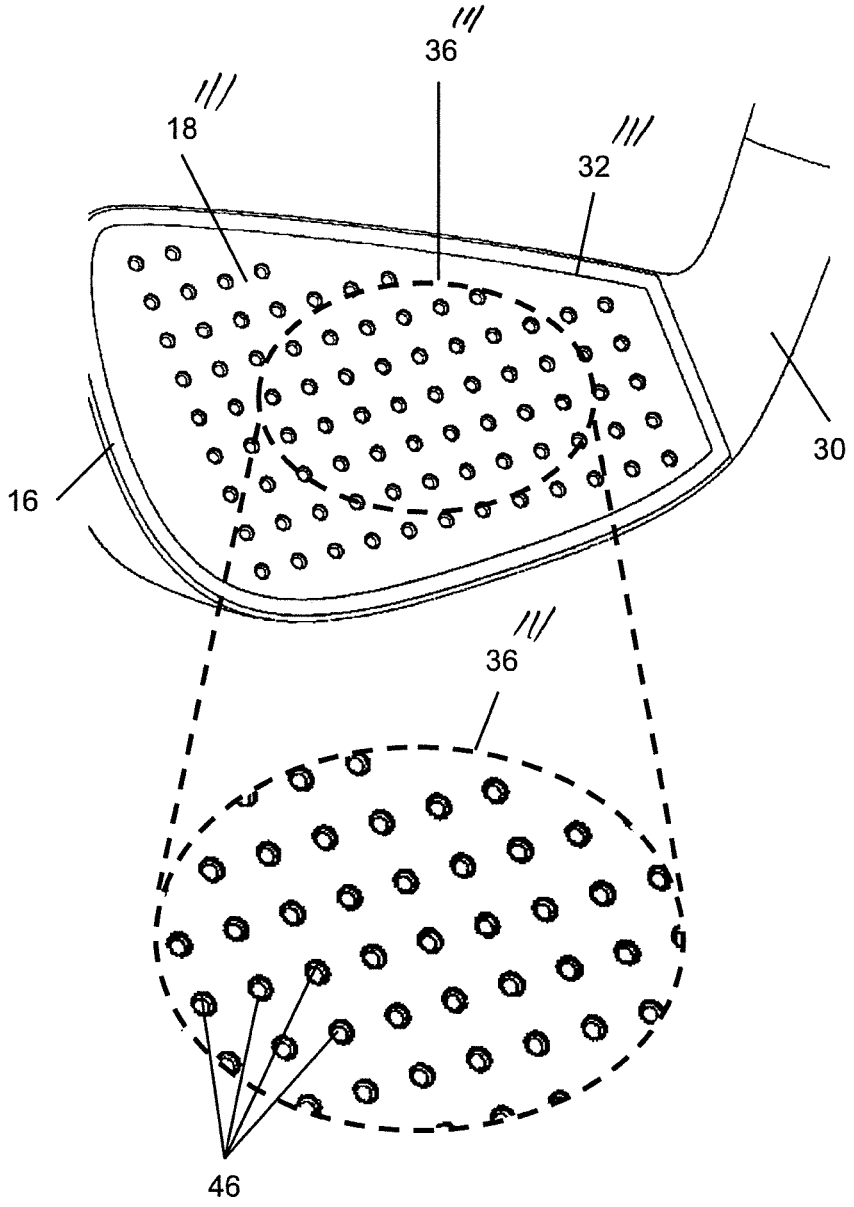
FIG. 7 is a partial perspective view of a golf club head which has an insert providing a ball striking surface which has one or more surface features, including punch marks spaced across the insert.

In contrast to FIGS. 4A-4C, the embodiments illustrated in FIGS. 5-7 show an insert 32 with a ball striking surface 18 having a variety of one or more surface features 36. The different types of surface features 36 illustrated in FIGS. 5-7 are only exemplary, and it should be understood that the striking surface 18 can comprise any number of desirable patterns or textures not limited to those illustrated in FIGS. 5-7.

Referring specifically to FIG. 5, the ball striking surface 18' of the insert 32' has surface features 36' configured as one or more ridges or ribs 38. The ridges or ribs 38 are raised or in other words, protrude outward from the insert 32'. As a result of each ridge or rib 38 protruding upward from the clubface 16, valleys or grooved portions 40 are located in between adjacent ridges or ribs. Alternatively, the raised/grooved arrangement of the surface features 36 in FIG. 5 can be reversed, such that reference numeral 38 of FIG. 5 can refer to valleys or grooves and reference numeral 40 can refer to raised rib or ridge portions. As shown in FIG. 5, the ridges/ribs 38 and grooves 40 generally extend vertically between the top and bottom of the insert 32' and comprise substantially all of the insert. Moreover, the vertical direction of the ridges/ribs 38 and rooves 40 is generally oriented parallel to a plane having an angle substantially similar to the loft angle of the clubface 16. Alternatively, the ridges/ribs 38 and grooves 40 can be generally oriented in a horizontal direction perpendicular to the plane having an angle substantially similar to the loft angle of the clubface 16 (not shown). In other words, the ridges/ribs 38 and grooves 40 can extend horizontally between the left and right side of the insert 32'.

Referring now to FIG. 6, an additional embodiment of an insert 32" with a ball striking surface 18" having a one or more surface features 36" is illustrated. The surface features 36" of FIG. 6 are configured in a more complex pattern compared to the ridges and/or grooves illustrated in FIG. 5. In particular, the surface features 36" comprising the ball striking surface 18" in FIG. 6 include two repeating patterns that cover substantially the insert 32". The first repeating surface feature pattern is a series of short grooves 42 that are generally oriented in a vertical direction parallel with a plane having an angle substantially similar to the loft angle of the clubface 16.

The first and second patterns 42, 44 are shown in FIG. 6 as alternating in a one-to-one fashion. That is, a first grooved pattern follows a first pair of raised ridges, a second pair of raised ridges follows the first grooved pattern, a second grooved pattern follows the second pair of raised ridges, etc. It should be understood, however, that the repeating surface feature patterns can alternate in any desired arrangement without departing from the scope of the present disclosure. For example, two sets of grooves may be located between a pair of raised ridges, etc.

Turning now FIG. 7, a further embodiment of an insert 32''' with a ball striking surface 18''' having a one or more surface features 36''' is illustrated. The surface features 36 of FIG. 7 are configured as a pattern of punch marks 46. The punch marks 46 cover substantially all of the insert 32''' and are sunken into or depressed therein. Moreover, the punch marks 46 are generally spaced equidistant to one another to form a pattern that can generally be described as cubic. However, it should be understood that the spacing of adjacent punch marks can be varied in any desired arrangement without departing from the scope of the present disclosure. For example, the punch marks 46 can form different patterns across the insert 32''', such as a diamond pattern, a radial pattern, etc.

As illustrated in FIGS. 5-7, each of the different surface features 36', 36", 36''' making up the ball striking surfaces 18', 18", 18''' of the inserts are adapted to contact an associated golf ball and transfer the kinetic energy of the golf club to the golf ball. Moreover, the inserts and the surface features which make up the ball striking surfaces may cover substantially all of the clubface 16 (except for perimeter portions thereof), as illustrated in FIGS. 5-7. Alternatively, the inserts 32', 32", 32''', and thus the surface features 36', 36", 36''', may cover just a smaller portion of the clubface such as a central "sweet spot" (not shown). However, in any event, the surface features illustrated in FIGS. 5-7 should be in accordance with the Rules of Golf issued by the USGA. Furthermore, while the various surface features illustrated in FIGS. 5-7 are mostly shown as being included on the insert individually, it should be understood that any combination of the individual surface features illustrated in FIGS. 5-7 could be included on an insert without departing from the scope of the present disclosure. For example, an insert could include at least two or more of the surface features illustrated in FIGS. 5-7, such as two or more surface features selected from a ridge or groove extending vertically between a top and a bottom of the face insert, a ridge or groove extending horizontally between the sides of the insert, and a bottom of the face insert, punch marks spaced across the insert, and repeating patterns thereof.

In addition, the different surface features 36', 36", 36'" illustrated in FIGS. 5-7 may vary throughout a set of golf clubs, from wedges to longer irons, depending upon the desired launch characteristics needed for optimal flight of each club. For example, it may be desirable to provide one type of surface feature on a longer iron, which may not be desirable on a wedge. To further exemplify this aspect of the present disclosure, the surface features 36' illustrated in FIG. 5 (i.e., vertically oriented ridges and/or grooves 38, 40) may be desired to optimize launch characteristics of shorter clubs in wet conditions, where the ridges and/or grooves help to disperse water yet not induce spin. As another example, a combination of horizontal/vertical ridges or grooves 42, 44 comprising the surface features illustrated in FIGS. 5-7 can be combined and varied in any number of arrangements on the clubface of each individual golf club, in order to optimize various performance characteristics. These performance characteristics include, but are not limited to, launch angle, spin rate, and carry distance (e.g., yardage) of the golf ball.

In some embodiments, the insert 32, 32', 32", 32'" is removably attached to the clubface 16. Such a configuration allows the insert to be removed from the clubface 16 whenever desired by the user of the golf club. After a significant period of use, the ball striking surface 18, 18', 18", 18'", which may include one or more surface features 36, 36', 36", 36'" as described above, may exhibit a degradation in performance characteristics due to, for example, the forceful nature of the impact between golf clubs and golf balls, the presence of debris (e.g., sand, dirt, grass, etc.), and/or exposure to natural elements (e.g., sunlight, water, cold air, etc.). As such, a user may want to remove the insert for reconditioning or replacement of the ball striking surface, thereby saving on costs which might otherwise be spent on replacing the entire golf club. Moreover, manufacturers may release upgraded or improved inserts and ball striking surfaces for various golf club models, if warranted by performance tuning and optimization demands that commonly change over time. These upgrades or improvements may include making the insert from a different material which provides the desired performance tuning and optimization. In this regard, a removable insert permits a golf club user to upgrade just the striking surface of the golf club head, as opposed to the entire golf club.

In accordance with a preferred embodiment of the disclosure, the ball striking surface 18, 18', 18", 18'" of each of the golf club heads described above and shown in FIGS. 1-7 has a combination of properties and/or surface features configured to improve various performance characteristics associated with the game of golf. These performance characteristics include but are not limited to an increased launch angle of the golf ball, a decreased spin rate of the golf ball, and an increased carry distance (e.g., yardage) of the golf ball. As mentioned above, the ball striking surface's combination of properties advantageously improves these performance characteristics at any given club speed by permitting a much more significant portion of the kinetic energy to be transferred to the propulsion of the golf ball forward/upward at impact and a much lower amount of the energy (than conventional golf clubs) to be converted to rotational energy that spins the ball. Moreover, less inadvertent loss of accuracy from off axis spin of the ball is achieved. Specifically, this combination of properties is achieved by a ball striking surface having some or all of the properties a) through g) described previously in this disclosure. Importantly, it has been found that the intrinsic lubricity of the ball striking surface is not a required characteristic. In other words, a particular coefficient of friction of the ball striking surface is not a critical property that results in the enhanced performance.

In particular, the properties of hardness, indentation resistance or compressive strength, and smoothness are preferred. A ball striking surface with some or all of the properties a) through g) described above also imparts improved durability, such that the ball striking surface can withstand repeated forceful golf ball impacts without a significant degradation in performance (a common problem with PTFE coatings). The ball striking surface thus forms a support structure for carrying the force of a golf ball impact from the clubface 16 to the heads 14, 22, 26, and 30 with minimal, if any, indentation.

In accordance with a preferred embodiment of the present disclosure, the clubface 16 comprises a ball striking surface 18, 18', 18", 18'" which is provided by a face insert, such as insert 32, 32', 32", 32'" described above. In other words, the ball striking surface and the insert are integral. That is, the ball striking surface and the insert are included as part of a whole rather than supplied as separate components. In such an embodiment, the advantageous combination of properties disclosed herein is intrinsic to the insert 32, 32', 32", 32'". This may be achieved, for example, by using an injection molding manufacturing process to form the insert and ball striking surface as a single body and from the same material which has the advantageous combination of properties. The material used to form the insert and striking surface can be the same or different from the material used to make the body member or golf club head 30.

The unitary or single bodied insert 32, 32', 32", 32'" and ball striking surface 18, 18', 18", 18'" is made from a material chosen for having the advantageous combination or properties discussed herein, including smoothness, hardness and durability. However, the intrinsic coefficient of friction is not the critical characteristic of the chosen coating that results in the enhanced performance. In particular embodiments, the insert is made from a polymeric material such as Acetal. Acetal is commercially available under the tradename Delrin. In other embodiments, the insert can be made from other polymeric materials, reinforced polymers, or ceramic or porcelain-based substances. Polymeric materials such as Acetal are preferable due to their ability to be injection molded and to provide high levels of hardness, compared with other plastic materials. Injection molding permits the manufacturing of inserts 32, 32', 32", 32'" having a wide variety of ball striking surfaces, which are easily imparted to the insert by designing a mold having the desired striking surface. For example, an injection mold can provide an insert with a smooth ball striking surface, such as the surface 36 illustrated in FIGS. 4A-4C, and/or the various surface features 36', 36", 36'" illustrated in FIGS. 5-7.

The unitary or single bodied insert 32, 32', 32", 32'" and ball striking surface 18, 18', 18", 18'" can have any desired thickness which protects against abrasion without exposing the underlying material of the golf club head, and which provides the advantageous combination of properties disclosed herein. Abrasion can result from the forceful nature of the impact between golf clubs and golf balls, the presence of debris (e.g., mineral particles, sand, dirt, grass, etc.), and/or exposure to natural elements (e.g., sunlight, water, cold air, etc.). In some particular embodiments, the insert has a thickness of about 500 μm to about 2,500 μm, and preferably about 750 μm to about 2,250 μm, and more preferably about 1,000 μm to about 2,000 μm.

In accordance with another embodiment of the present disclosure, the ball striking surface 18 and the clubface 16 of the golf club heads 14, 22, 26, and 30 are integral. That is, the ball striking surface 18 and clubface 16 are included as part of a whole rather than supplied separately. In such an embodiment, the advantageous combination of properties disclosed herein is intrinsic to the clubface and the ball striking surface. This may be achieved, for example, by manufacturing the golf club head, clubface, and ball striking surface from the same material having the advantageous combination of properties. As another example, a surface treatment could be performed on the clubface to form the ball striking surface with the combination of properties, such as through a surface hardening or work hardening process known in the art.

Figure 8:
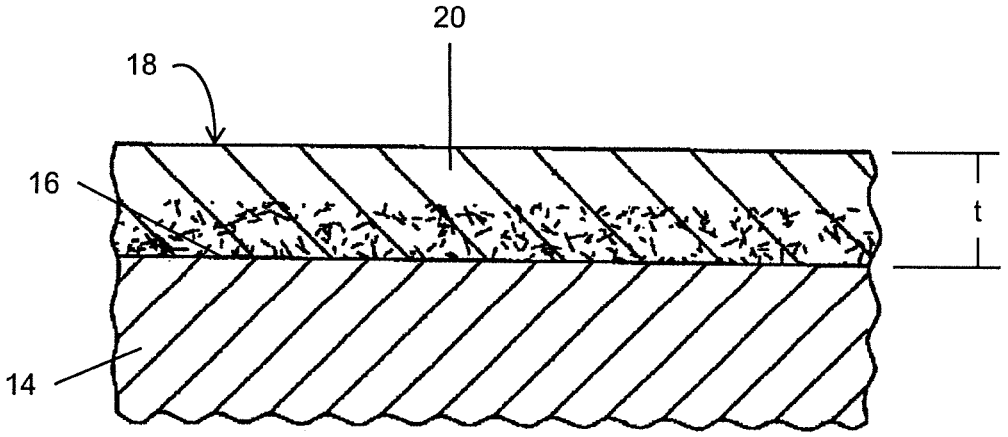
FIG. 8 is a partial cross-sectional view of a layer of coating disposed on a clubface of a golf club head according one aspect of the present embodiment.

FIG. 8 illustrates another embodiment according to aspects of the present disclosure, wherein the clubface 16 of the golf club head 14 is supplied with a separate component which provides the ball striking surface 18 having the advantageous combination of properties presently disclosed. In particular, the separate component is one or more layers of a coating 20 disposed on at least a portion of the clubface 16 of golf club head 14 to form a ball striking surface 18. The coating 20 can comprise multiple layers at any desired thickness t to form the ball striking surface 18 with the advantageous combination or properties. The coating 20 is a substance chosen for having the advantageous combination or properties discussed herein, including smoothness, hardness and durability. However, the intrinsic coefficient of friction is not the critical characteristic of the chosen coating that results in the enhanced performance.

The coating 20 forming the ball contacting surface 18 is adapted to impact an associated golf ball and transfer the kinetic energy of the golf club to the golf ball. In this regard, the ball striking surface 18 comprising the coating 20 may comprise substantially all of the clubface 16 of the golf club head 14, or just a portion thereof. For example, the coating 20 can be applied at a centrally located "sweet spot" of the clubface, or could be applied to cover the entire clubface. Moreover, while golf club head 14 is illustrated in FIG. 8 as receiving the coating 20, it should be understood that any of the golf club heads discussed herein could similarly receive the coating without departing from the scope of the present disclosure, including heads 22, 26, and 30 illustrated in FIGS. 2, 3, 4A-4C, and 5-7, respectively.

If the coating 20 is applied to head 22 of FIG. 2, the surface features 24 can already be formed on the clubface 16 such that the coating is disposed over the surface features to form the ridged and/or grooved ball striking surface 18 of the golf club head. Alternatively, the coating 20 can be applied to the clubface 16 such that the coating itself forms the surface features 24 of golf club head 22.

Referring now to golf club head 30 of FIGS. 4A-4C, the coating 20 can be applied to the insert 32 to form the ball striking surface 18. In this regard, the insert 32 may further comprise a substrate (not shown) and the coating 20 is applied to at least a portion of the substrate. The substrate of the insert 32 and the clubface 16 of the golf club head 30 can be made from the same or different materials. However, when the insert 32 is configured as an inlay insert as described above, the coating 20 is applied to the substrate of the insert such that when the insert is attached to the clubface 16, the ball striking surface 18 formed by the coating is still substantially flush with the surrounding portions of the clubface in accordance with the Rules of Golf issued by the USGA. When the insert 32 is configured as an overlay insert as described above, the coating 20 is applied to the entire substrate of the insert to provide a ball striking surface 18 which entirely covers the clubface 16.

With reference back to FIG. 8, in some particular embodiments the coating 20 material is a polymeric isocyanate derivative such as polyurethane, including modified polyurethanes like oil modified polyurethane. A polyurethane coating 20 is applied at a suitable thickness t to provide the advantageous combination of properties disclosed herein, including a range of about 100 μm to about 200 μm, and preferably about 115 μm to about 185 μm, and more preferably about 125 μm to about 185 μm. When the coating 20 is applied as one or more layers, the thickness of the one or more layers comprising the coating is preferably maintained within the aforementioned range. A coating material which is commercially available under the trade POR-15® is presently preferred for use. The application of ball striking surfaces comprising the POR-15® coating, a coating not known for its low coefficient of friction nor commonly used in connection with golf clubs, unexpectedly enhanced the performance characteristics of golf clubs, as shown in the Example below.

A process for applying the polyurethane coating 20 to the clubface 16 or insert 32, 32', 32", 32'" of a golf club will now be described. If a substantially smooth ball striking surface is desired, an optional first step is to smooth out the clubface or insert by removing any unwanted surface features and roughness on the clubface by techniques know in the art, including grinding, sanding, etc., and the like. If the clubface or insert is to include surface features, or is already prepared to an adequate smoothness, a surface preparation step is first performed. The surface preparation step involves removing all visible oil, grease, soil, dirt, and other contaminants from the golf club head. Surface preparation can also include an acid etching step known in the art to clean the clubface or insert. The coating can then be disposed on the clubface or insert using known application techniques, such as spraying, airless spraying, brushing, or rolling. Additional layers of coating are then applied as desired, allowing each preceding coat to dry for approximately 1 to 2 hours before application of subsequent coat layers. In some particular embodiments, 3 to 4 layers of coating has been found to impart the advantageous combination of properties to the ball striking surface of the golf club heads disclosed herein. Once the desired number of coating layers is applied, the coating should be allowed to cure for approximately one day.

A coating comprising modified polyurethane provides a ball striking surface 18, 18', 18", 18'" superior to PTFE in durability, performance and cost of manufacture. Modified polyurethane coatings are typically used for the purpose of corrosion protection of metal surfaces. The application of these compounds to enhance the performance characteristics of golf clubs is both non-obvious and effective.

Moreover, even though FIGS. 1-8 illustrate and the above disclosure describes a preferred embodiment of a golf club providing a clubface 16 and a ball striking surface 18, 18', 18", 18'", it is contemplated that, without deviating from the scope of the present disclosure, other items of sports equipment can provide a face having a striking surface with the advantageous combination of properties disclosed herein. For example, other types of sports equipment that may similarly benefit from enhanced surface strike performance due to the advantageous combination of properties disclosed herein include, but are not limited to, baseball bats, hockey sticks, polo mallets, croquet mallets bocce balls, bowling balls, billiard balls, etc., and the like. These additional types of sports equipment can include the combination of properties intrinsically or through the use of coatings and/or inserts as discussed above.

It is contemplated that other coatings and materials can be used and applied to the clubface to provide a ball striking surface having the advantageous combination of properties disclosed herein. For example, the golf clubface may be coated with a baked on porcelain material as used in non-stick cookware or appliance surfaces. Additionally, a ceramic coating may also be used to achieve the required surface properties. A powder coating of polyurethane or other acceptably hard and durable material may also be used.

Figure 9:
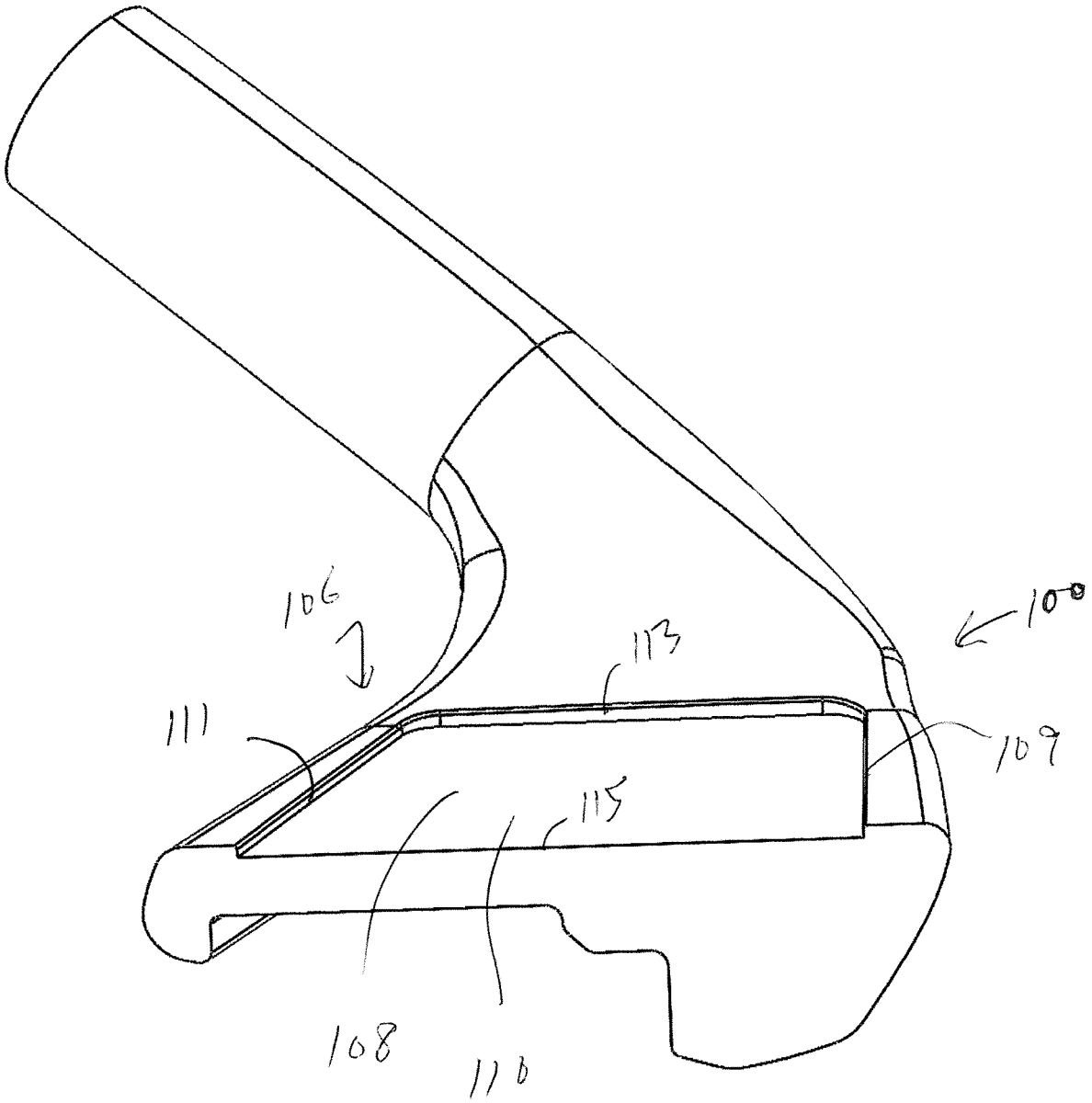
FIG. 9 is a perspective cross-sectional view of a club head with a recess formed therein in accordance with another embodiment of the disclosure.
Figure 10:
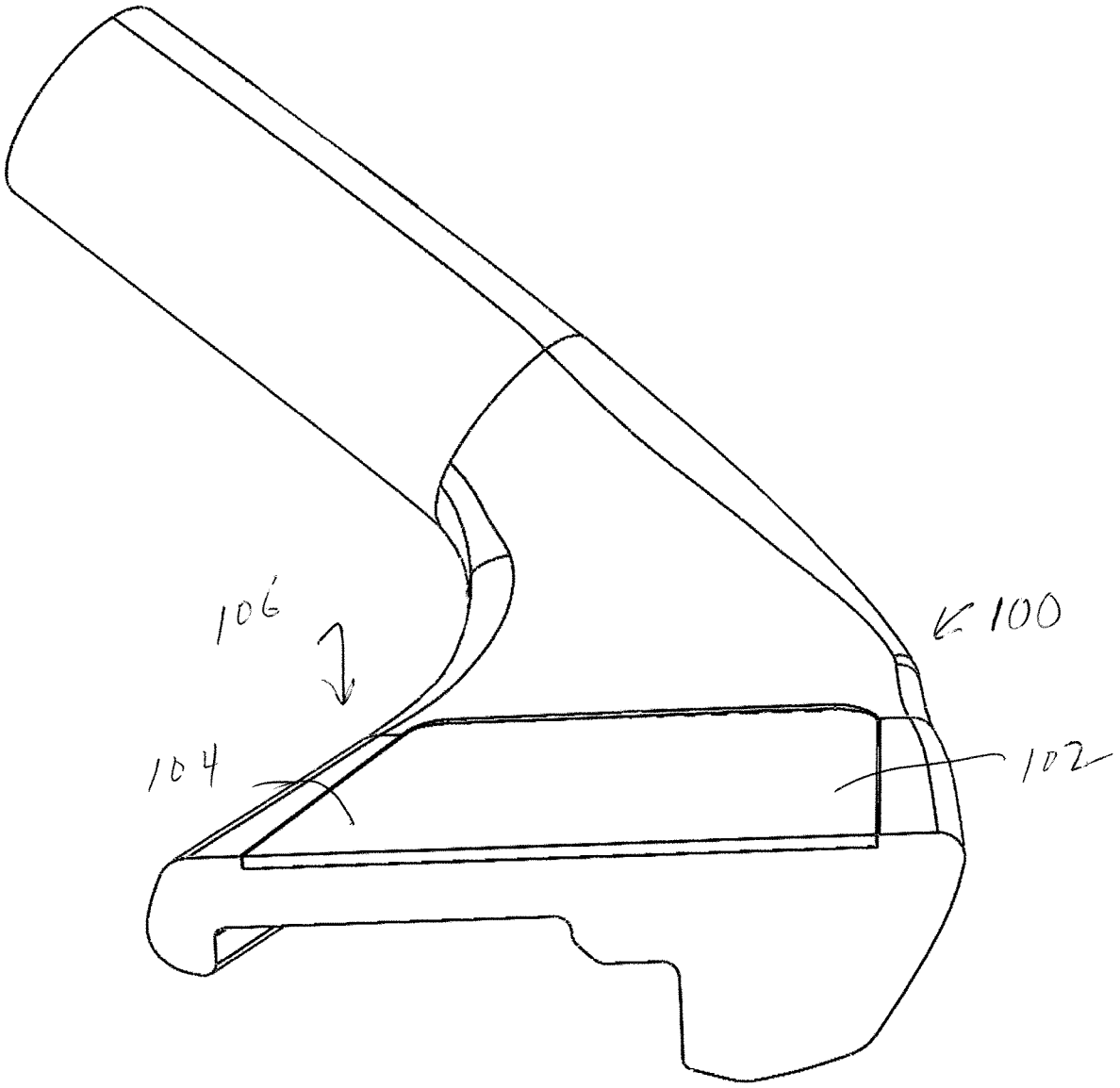
FIG. 10 is a perspective cross-sectional view of a club head with a ceramic inlay in a recess of the club head in accordance with another embodiment of the disclosure.
Figure 11:
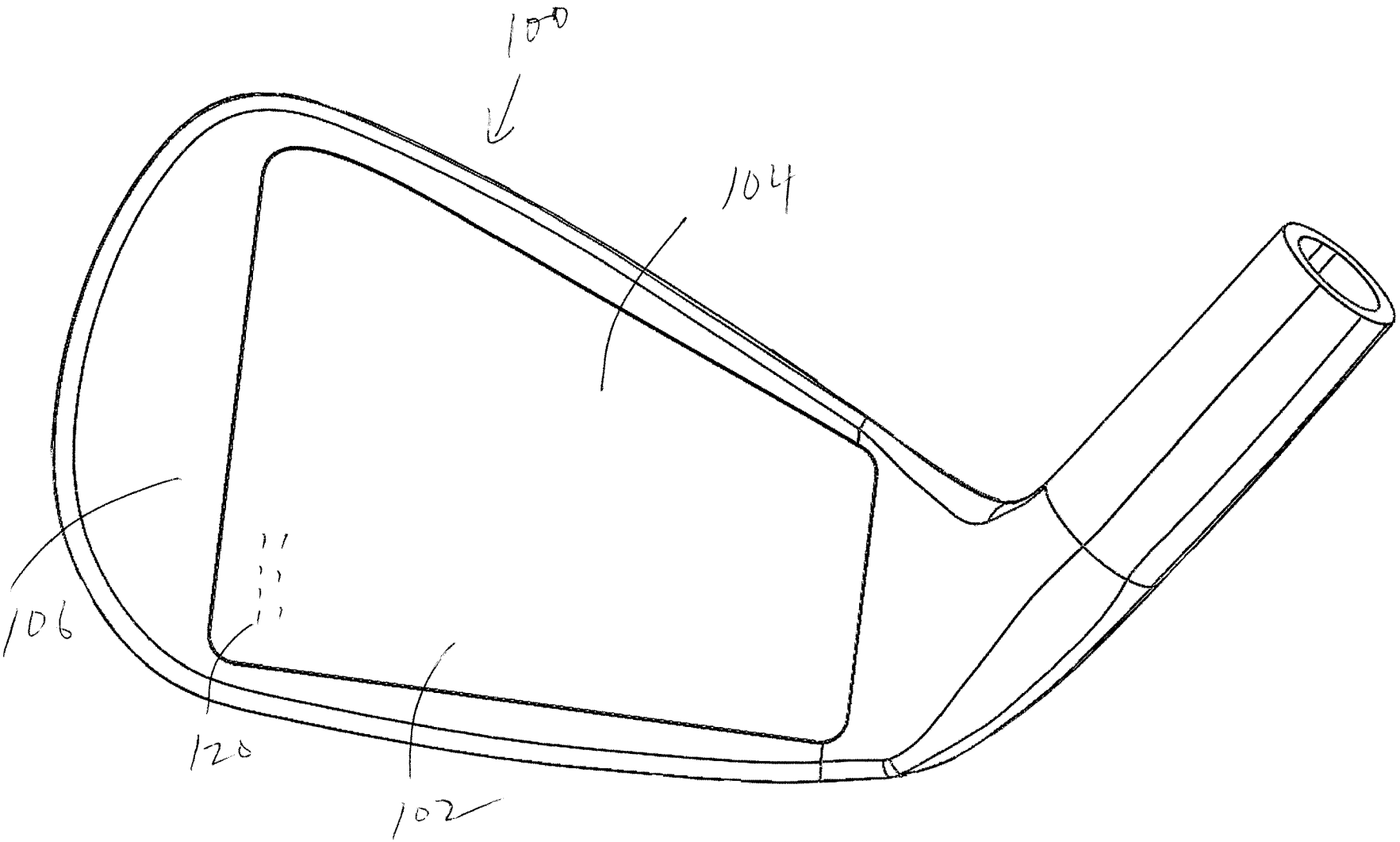
FIG. 11 is a perspective view of the club head showing the ceramic inlay in accordance with another embodiment of the disclosure.

Referring now to FIGS. 9-11, another preferred embodiment of the present disclosure is shown. A golf club head 100 which in accordance with the preferred embodiment of the disclosure is configures as an "iron" club, such as the 7-iron illustrated in FIG. 9. However, it should be understood that golf club head 100 could also be configured as any other iron club or as a "wood" or driver club without departing from the scope of the present disclosure. Additionally, other types of sports equipment adapted to strike respective balls associated with the sport are contemplated. In this regard, the head 100 can more generally be referred to as a body member adapted to strike an associated ball. The body member or golf club head 100 of FIGS. 9-11 differ from those illustrated in FIGS. 1-3 in that the ball striking surface 102 comprises a separate inlay material 104 that is completely separate from the rest of the body member or golf club head. Moreover, the inlay material is formed on the club face within a recessed portion.

In this regard, the clubface 106 includes a receiving portion 108 adapted to receive the inlay material 104. The receiving portion 108 can be recessed into the clubface 106 such that the inlay material 104, and thus the ball striking surface 102, is substantially flush with the surrounding portions of the clubface in accordance with the Rules of Golf issued by the USGA. The receiving portion or recess 108 is preferably rectangular in shape and is formed by four walls 109, 111, 113, 115. The receiving portion preferably has a depth of about 0.75 mm or 0.03 inches. However, other depths are contemplated by the disclosure.

The ball striking surface 102 formed by the inlay material 104 received by receiving portion 108 in the face or clubface 106 of the golf club head 100 can be configured to have one or more surface features or textures, such as ridges or grooves, or be configured to be substantially smooth. In the embodiment illustrated in FIGS. 9-11, the inlay material 104 is configured to have a substantial smooth strike surface 102.

When a substantially smooth ball striking surface 102 is desired, an optional first step is to smooth out the clubface or receiving portion by removing any unwanted surface features and roughness on the clubface by techniques know in the art, including grinding, sanding, etc., and the like. If the clubface is to include surface features, or is already prepared to an adequate smoothness, a surface preparation step is first performed. The surface preparation step involves removing all visible oil, grease, soil, dirt, and other contaminants from the golf club head. Surface preparation can also include an acid etching step known in the art to clean the clubface or receiving portion.

One aspect of the disclosure is that the inlay material 104 is not mechanically fastened or glued to the club face. Rather, the inlay material is poured into the recess and is formed on the actual club face and is thereby fused or bonded directly to the club face and within the recess portion, which is completely filled with the inlay material. Thus, there is no separate insert manufactured separate from the club head and inserted. Indeed, it would be highly impractical to create the ceramic inlay material outside of the club head. The inlay would not be able to retain its shape and completely fill the recess portion as desired.

A problem with some coating insert processes is that the coating is sprayed onto the club face (such as a polyurethane coating) and it is not durable enough to withstand the impact from a golf ball.

Another problem with a coating such as polyurethane is it is too soft in relation to, for example, sand (with a hardness of 7) when the club hits sand and will end up deforming the coating on the club face. Thus, a striking surface of sufficient durability and hardness is desired.

Also, if the ceramic inlay were to be glued onto the club face, there would be a semi-soft adhesive underneath the insert which would not tolerate deformation of the insert upon impact with a golf ball or sand. Thus, the present disclosure does not contemplate a separate adhesive material.

In accordance with the preferred embodiment of the disclosure, the method for improving the surface strike performance of a golf iron club includes providing a golf iron clubhead 100 made of a suitable metallic material (i.e., 431 SS). The clubhead is similar in design to typical golf irons. The clubhead would be similar in design to typical golf irons.

The clubhead has a designated region or recess 108 formed on a club face 106 of the club configured to receive inlay material 104 and create on improved strike surface 102.

The recess 108 is generally rectangular in shape and extends across a substantial portion of the club face 106.

The recess or pocket 108 forms the region for receiving the inlay material 104. The inlay material is preferably an amorphous ceramic material 104 applied to the recess 108 of the club as a liquid slurry. The inlay material specifically is an amorphous ceramic material which includes ground glass, borosilicates, hardeners and pigments. It preferably has the chemical physical properties of glass versus clay. Clay ceramic material would not be suitable for this application. The surface texture of clay is granular and not smooth enough to properly serve as a striking surface.

Amorphous ceramic material has the appropriate hardness similar to glass (i.e., 7 on the Moh scale), as well as the durability to withstand impact and scratches, etc. It serves as the appropriate surface material for interaction with the ball to change the flight characteristics.

In contrast, clay-like ceramic material cannot be polished and cannot be fastened or screwed on and will likely crack.

The amorphous ceramic material serves as an inlay which is poured or deposited into the recess as a liquid slurry. That is, a slurry is distributed evenly in the pocket such that there is a uniformly thick layer of ceramic material filling the pocket. The ceramic material layer is preferably about 0.75 mm or 0.03 inches thick and may extend slightly above walls 109, 110, 111, 113, 115, 110 of recess 108.

The slurry is allowed to dry while the clubface is in a position parallel to the ground so as to avoid any unevenness to the layer's thickness. Typically, it takes about 4 to 6 hours at room temperature and moderate humidity for the slurry to harden and completely dry. The drying process can be accelerated with the use of a low temperature drying oven.

The clubhead 100 is then treated with the dried slurry is fired at high temperature through a heating process at a temperature of about 1830° F. for about four hours. The temperature is held, then slowly reduced.

The initial heating phase is slowly increased until temperatures are uniformly held at just below the glassification temperature of the ceramic substrate, which is about 1800 degrees Fahrenheit. The temperature is increased to create glassification and held for a time span found to result in the desired surface texture after cooling. After firing the ceramic strike surface is modified by low speed linear polishing.

In accordance with another aspect of the disclosure, the ceramic surface produced during the firing process can be ground with a series of abrasive wheels to create micro-grooves 120 (FIG. 11) in the surface that run in a vertical direction. The grooves serve to increase the strike performance of the club head.

In accordance with the preferred embodiment of the disclosure, the ball striking surface 102 of the golf club head described above and shown in FIGS. 9-11 has a combination of properties and/or surface features configured to improve various performance characteristics associated with the game of golf. These performance characteristics include but are not limited to an increased launch angle of the golf ball, a decreased spin rate of the golf ball, and an increased carry distance (e.g., yardage) of the golf ball. As mentioned above, the ball striking surface's combination of properties advantageously improves these performance characteristics at any given club speed by permitting a much more significant portion of the kinetic energy to be transferred to the propulsion of the golf ball forward/upward at impact and a much lower amount of the energy (than conventional golf clubs) to be converted to rotational energy that spins the ball. Moreover, less inadvertent loss of accuracy from off axis spin of the ball is achieved. Specifically, this combination of properties is achieved by a ball striking surface having some or all of the properties a) through g) described previously in this disclosure.

Importantly, it has been found that the intrinsic lubricity of the ball striking surface is not a required characteristic. In other words, a particular coefficient of friction of the ball striking surface is not a critical property that results in the enhanced performance.

In particular, the properties of hardness, indentation resistance or compressive strength, and smoothness are preferred. A ball striking surface with some or all of the properties a) through g) described above also imparts improved durability, such that the ball striking surface can withstand repeated forceful golf ball impacts without a significant degradation in performance. The ball striking surface 102 thus forms a support structure for carrying the force of a golf ball impact from the clubface 106 to the head with minimal, if any, indentation.

The following example is provided to illustrate the processes related to the present disclosure. The example is merely illustrative and is not intended to limit the disclosure to the materials, conditions, or process parameters set forth therein.

EXAMPLE

Tests were performed to show the advantage of utilizing a ball striking surface having the advantageous combination of properties disclosed herein, including hardness, smoothness, and durability. Various performance characteristics associated with the game of golf can be improved through the use of the ball striking surface having this advantageous combination of properties. Such performance characteristics include an increased launch angle of the golf ball, a decreased spin rate of the golf ball, and an increased carry distance (e.g., yardage) of the golf ball.

Two golf clubs of the same type and brand were acquired. In particular, two Callaway® 9-irons were used, each having a 39° loft. One of the golf clubs was modified to have the ball striking surface disclosed herein for comparison with the other golf club, which was left unmodified. To provide the modified golf club with the ball striking surface, a coating of polyurethane material commercially available under the trade name POR-15®, and having the advantageous combination of properties disclosed herein, was used. POR-15® was coated on the clubface of the modified golf club in accordance with the method discussed above.

Numerous golf balls of the same brand were struck with the modified and unmodified golf clubs and various measurements were recorded. Using a FlightScope® ball tracking monitor, radar, and launch monitor, the golf ball carry distance, golf ball speed, club speed, golf ball spin rate, and golf ball launch angle were recorded for each golf shot with the modified and unmodified golf club. The shots were taken outside to simulate real-world conditions, and the data was collected for the full flight of the ball. In other words, the carry distances of the golf balls was actually measured and not extrapolated from initial launch conditions. The results are presented in Table 1 below:

TABLE 1

Performance Measurements of Modified and Unmodified Golf Club

| Shot | Carry (yds) | Ball (mph) | Club (mph) | Spin (rpm) | Launch V (°) |
|---|---|---|---|---|---|
| Modified Golf Club | | | | | |
| 3 | 165.6 | 102.6 | 89.1 | 2965 | 29.9 |
| 4 | 171.6 | 106.1 | 86.9 | 2797 | 30.5 |
| 5 | 163.8 | 105.7 | 94.5 | 2553 | 27.5 |
| 6 | 150 | 95.8 | 87.8 | 2398 | 32.6 |
| Average | 162.75 | 102.55 | 89.575 | 2678.25 | 30.125 |
| Unmodified Golf Club | | | | | |
| 14 | 134.1 | 104.3 | 85.5 | 7924 | 25.3 |
| 15 | 133.5 | 106.8 | 85.8 | 8168 | 28.6 |
| 16 | 127.1 | 98.3 | 90.2 | 6368 | 28.7 |
| 17 | 132 | 102.5 | 86.7 | 6082 | 29.1 |
| Average | 131.675 | 102.975 | 87.05 | 7135.5 | 27.925 |

As shown in Table 1 above, the modified club produced between about 16 yards to about 45 yards increased carry distance and an average increased carry distance of over 30 yards compared with the unmodified golf club, with no significant increase in ball velocity. In addition, the launch angle achieved by the modified golf club increased by as much as about 7 degrees, with an average launch angle increase of about 2 degrees compared with the unmodified golf club. Moreover, the modified golf club decreased spin rate by as much as about 70%, with an average decrease in spin rate of about 60% compared with the unmodified golf club. In summary, the results in Table 1 show that a ball striking surface having a combination of properties a)-g) disclosed above will increase the launch angle of the struck ball and reduce the spin rate. As a result, longer and higher ball flight, less lateral dispersion of an incorrectly struck ball, and a more beneficial descent angle are achieved.

The improved performance characteristics achieved by the modified golf club is attributed to the ball striking surface having the advantageous combination of properties disclosed herein. For example, properties such as hardness and resistance to indentation of the ball striking surface, in combination with the smoothness, prevents the golf ball from developing significant mechanical engagement with ball striking surface upon impact with the golf club, thereby reducing the amount of imparted spin. Because less kinetic energy is converted to rotational energy that spins that ball, a much more significant portion of the kinetic energy is transferred to the forward/upward propulsion of the golf ball, thereby improving the launch angle and increasing the carry distance. The application of ball striking surfaces having this combination of properties to enhance the performance characteristics of golf clubs is un-expected, effective, and non-obvious.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the above disclosures or the equivalents thereof.

The invention claimed is:

1. A method of creating a low spin inducing strike surface of an iron type golf club head, comprising:

providing a golf club head having a club face and a receiving portion recessed into the club face;

depositing a material comprising amorphous ceramic material including ground glass and borosilicate into the receiving portion as a liquid slurry such that said amorphous ceramic material is distributed evenly within the receiving portion; and firing said club face to create glassification of said amorphous ceramic material to create a strike surface; and fuse said strike surface directly to said receiving portion of said golf club head.

2. The method of claim 1, further comprising drying said liquid slurry while said club face of said golf club head is positioned parallel to the ground.

3. The method of claim 1, further comprising grinding said amorphous ceramic material with a series of abrasive members creating microgrooves on an outer surface of the ceramic material.

4. The method of claim 3, wherein said microgrooves extend in a vertical direction along the outer surface of the amorphous ceramic material.

5. The method of claim 1, wherein said receiving portion extends across a substantial portion of a width of said club face of said golf club head.

6. The method of claim 5, wherein said receiving portion has a depth of about 0.75 mm or 0.03 inches.

7. The method of claim 6, wherein said amorphous ceramic material has a depth of about 0.75 mm or 0.03 inches.

8. The method of claim 1, wherein said amorphous ceramic material has a hardness of 7 Moh.

9. The method of claim 1, further comprising modifying the strike surface by polishing said strike surface after firing.

10. The method of claim 1, wherein said amorphous ceramic material further comprises hardeners and pigments.

11. The method of claim 1, wherein said golf club head is fired with said club face parallel to the ground.

* * * * *